US007574885B2

(12) United States Patent
Hansen

(10) Patent No.: US 7,574,885 B2
(45) Date of Patent: Aug. 18, 2009

(54) METHOD FOR THE MANUFACTURING OF A FLUID CONDUIT, PARTICULARLY A FLUID CONDUIT IN A $CO_2$ REFRIGERATION SYSTEM

(75) Inventor: Christian Boerge Hansen, Haderslev (DK)

(73) Assignee: Danfoss A/S, Nordborg (DK)

( * ) Notice: Subject to any disclaimer, the term of this patent is extended or adjusted under 35 U.S.C. 154(b) by 164 days.

(21) Appl. No.: 10/592,890

(22) PCT Filed: Mar. 15, 2005

(86) PCT No.: PCT/DK2005/000175

§ 371 (c)(1),
(2), (4) Date: Jan. 19, 2007

(87) PCT Pub. No.: WO2005/087403

PCT Pub. Date: Sep. 22, 2005

(65) Prior Publication Data

US 2007/0137275 A1 Jun. 21, 2007

(30) Foreign Application Priority Data

Mar. 16, 2004 (DE) ..... 10 2004 012 987

(51) Int. Cl.
*B21F 3/04* (2006.01)

(52) U.S. Cl. ..... 72/142; 72/130; 72/169; 72/369; 29/890.037

(58) Field of Classification Search ..... 72/64, 72/65, 127, 130, 135, 137, 166, 168, 169, 72/170, 171, 172, 367.1, 369, 141, 428; 29/726.5, 29/727, 890.037, 890.043, 890.053
See application file for complete search history.

(56) References Cited

U.S. PATENT DOCUMENTS

| | | | | | |
|---|---|---|---|---|---|
| 2,145,040 | A | * | 1/1939 | Cawthra | 29/505 |
| 3,444,716 | A | * | 5/1969 | Martin | 72/135 |
| 3,482,425 | A | * | 12/1969 | Lagman et al. | 72/174 |
| 3,646,599 | A | | 2/1972 | Lightbody | 72/147 |
| 3,742,567 | A | | 7/1973 | Kaelin | 29/157.3 |
| 3,938,558 | A | | 2/1976 | Anderson | |
| 4,155,158 | A | * | 5/1979 | Gurrera-Folch | 29/727 |
| 4,434,539 | A | * | 3/1984 | Sanborn et al. | 29/890.037 |
| 4,451,960 | A | | 6/1984 | Molitor | 29/157.3 |
| 5,737,828 | A | * | 4/1998 | Barnes | 29/727 |
| 6,052,898 | A | * | 4/2000 | Corrigan | 29/890.037 |

(Continued)

FOREIGN PATENT DOCUMENTS

DE 80 26 871 U1 10/1980

(Continued)

*Primary Examiner*—Edward Tolan
(74) *Attorney, Agent, or Firm*—McCormick, Paulding & Huber LLP

(57) ABSTRACT

The invention relates to a method for producing a fluid conduit, in particular a fluid conduit for a $CO_2$ refrigerating plant. The aim of said invention is to develop a quick and inexpensive method. For this purpose, several pipes (5-9) are simultaneously supplied by means of at least one roller (11) which is provided with peripheral grooves (14) and are helically wound in a parallel direction with respect to each other, wherein each pipe (5-9) is guided along a helical line and the helical lines of all pipes (5-9) are parallel to each other.

16 Claims, 2 Drawing Sheets

U.S. PATENT DOCUMENTS

| | | | | |
|---|---|---|---|---|
| 6,203,707 | B1 * | 3/2001 | Hartmann | 210/650 |
| 7,308,932 | B2 * | 12/2007 | Doh et al. | 165/138 |

FOREIGN PATENT DOCUMENTS

| | | | |
|---|---|---|---|
| DE | 83 20 837 | U1 | 12/1983 |
| DE | 84 07 241 | U1 | 3/1984 |
| DE | 36 16 774 | A1 | 11/1987 |
| DE | 202 14 563 | U1 | 1/2003 |
| EP | 0 102 905 | B1 | 9/1983 |

* cited by examiner

METHOD FOR THE MANUFACTURING OF A FLUID CONDUIT, PARTICULARLY A FLUID CONDUIT IN A $CO_2$ REFRIGERATION SYSTEM

CROSS REFERENCE TO RELATED APPLICATIONS

This application is entitled to the benefit of and incorporates by reference essential subject matter disclosed in International Patent Application No. PCT/DK2005/000175 filed on Mar. 15, 2005 and German Patent Application No. 10 2004 012 987.8 filed Mar. 16, 2004.

FIELD OF THE INVENTION

The invention concerns a method for the manufacturing of a fluid conduit, particularly a fluid conduit in a $CO_2$ refrigeration system.

BACKGROUND OF THE INVENTION

In many technical systems, for example refrigeration systems or hydraulic systems, a fluid under high pressure and/or under high temperature is transported. The conduits used for this purpose are usually made of metallic materials and have relatively large wall thicknesses. When at the same time flexible conduits are desired, for example in order to satisfy demands for vibration stability, these conduits are often wound around their longitudinal axis. Such wound conduits can, however, only be made with a limited cross-section. When a larger flow amount is required, the conduit is divided into a plurality of single pipes. The individually wound pipes are subsequently pushed into each other. This method is relatively expensive and requires narrow tolerances with regard to the pitch and the diameter of the windings.

A refrigeration system usually comprises several components. Some of these are a compressor, two heat exchangers and a valve. These components are connected to each other through conduits. Particularly with mobile applications, for example refrigeration systems, which are used for cooling in vehicles, these conduits must not only have corrosion stability and vibration stability, but also a certain flexibility. On the other hand, such a conduit must have a substantial pressure resistance, particularly when $CO_2$ (carbon dioxide) is used as refrigerant. This makes such conduits relatively expensive.

BRIEF SUMMARY OF THE INVENTION

The invention is based on the task of providing a fast and cost efficient method for the manufacturing of a fluid conduit.

According to the invention, this task is solved in that several pipes are simultaneously supplied by means of at least one roller, which is provided with peripheral grooves and are helically wound in a parallel direction with respect to each other, wherein each pipe is guided along a helical line, the helical lines of all pipes being parallel to each other.

With this embodiment, relatively thin pipes can be used. The effective cross-section of the fluid conduit then results from the sum of the cross-sections of all pipes. Pipes with a relatively small cross-section have a relatively high pressure resistance, that is, the costs to be spent on pressure resistance can be kept small. The helical line shaped arrangement of the individual pipes also provides a certain flexibility. The manufacturing becomes particularly cost effective by the fact that several pipes can be wound at the same time and in parallel. This practically automatically results in an arrangement of the pipes in such a manner that the pipes are located adjacently or at a predetermined distance to each other. Subsequent mounting of individual pipes in each other or adjustment can be avoided. With the winding of the pipes, a large share of the manufacturing process is finished. The method is in principle suited for the manufacturing of fluid conduits, for example for hydraulic or refrigeration systems. However, the method becomes a particular importance for systems working with a refrigerant being under a higher pressure, for example $CO_2$ (carbon dioxide). Here, the pipes are supplied over at least one roller, which is provided with peripheral grooves. With this roll, the desired lateral alignment of the pipes in relation to each other can be realised in a simple manner. When several rollers are used in this manner, the periphery of the individual windings of the helical line can help provide a relatively exact positioning of the individual pipes in relation to each other. As soon as the pipes have been bent over an initial angle of for example 10°, a guiding with rollers is no longer absolutely required, as, once formed, the windings will not unwind again by themselves.

It is preferred that after making the windings, the pipes are cut to length one by one, the bundle formed by the pipes being twisted by a predetermined angle between the individual cutting processes. Thus, it is considered that later, when all the windings have been finished, the individual pipes should all end at approximately the same axial position of the "screw". A sequential cutting and twisting the pipe bundle ensures that the cutting process can always take place in the same spot. The correct length of the individual pipes will thus be achieved practically automatically. With this method, conduits can in principle be made continuously in desired and different lengths. The method is therefore excellently suited for mass production, however at the same time meets the requirements of a fast type shift.

Preferably, after winding, the ends of the pipes are bent over in parallel to the axis of the helical line. This makes it easier to mount a connection for the pipes. The subsequent mounting process is thus simplified.

Preferably, at least the helically shaped winding area of the conduit is embedded in a plastic material. Here, the term "plastic material" could also cover a rubber. The plastic material stabilises the "body" of the conduit, at the same time ensuring that the conduit has a certain flexibility. The plastic covering does not only provide a mechanical stabilisation. It also ensures an increased thermal resistance towards the environment, so that the heat losses can be kept small. Further, the embedding provides a corrosion protection for the pipes, particularly when used in aggressive environments.

Preferably, before the embedding, the ends of the pipes are twisted by a predetermined angle in relation to each other against the winding direction, are held in the twisted position during the embedding and are released after the embedding. For example, the ends can be twisted in relation to each other by approximately 10°. This gives small clearances between adjacent windings, where the plastic material can penetrate. The embedding with the plastic material can, for example, be made by means of an injection moulding process. The clearances between the windings filled by the plastic material prevent the pipes from touching each other. During operation of the refrigeration system, the pipes are prevented from hitting or rubbing on each other. Thus, undesired noises are prevented, and the risk of possibly occurring leakages caused by wear of the pipes in the contact points is reduced. When, after the injection moulding (or another embedding process), the ends are released, the windings of the helical axes of all pipes are under a certain pretension. This further contributes to an improvement of the stability of the conduit.

In a preferred embodiment, it is provided that during embedding of the conduit a core within the windings is kept free. This means that the plastic material has the shape of a hollow cylinder. The hollow inside saves weight. The fact that the inner space or the core is kept free improves the flexibility of the conduit. If desired, it will also be possible to guide additional devices, for example electrical cables or the like through the inside of the conduit.

Preferably, ends belonging together are provided with a common connecting piece. This simplifies the subsequent mounting of the conduit in a technical system, for example a refrigeration system.

It is preferred that the connecting piece is connected to the plastic material. This ensures improved pressure resistance over the whole length of the conduit. There is no position, in which shear forces could act upon the pipes. On a whole, this improves the stability of the conduit.

It is preferred that the connecting piece is pressed against and welded onto the plastic material. This gives a very stable connection between the connecting piece and the plastic material. After loosening the pressing force, a slightly increased pretension occurs in the axial direction of the helical line.

Preferably, the ends of the pipes are guided through the connecting piece and an occurring excess length is cut off. Thus, it is achieved that the pipe ends flush with the front face of the connecting piece. The guiding of the refrigerant is then exclusively handled by the pipes, which are preferably made of a suitable metal, for example, aluminium. The plastic material merely has supporting purposes.

It is preferred that the cutting is made by means of laser. The laser is able to cut off the excess lengths so that they flush with the front face of the connecting piece.

Preferably, at least one guide roller is provided, whose rotational axis encloses an acute angle in relation to the axis of the roller. The guide roller causes a lateral deflection movement of the supply pipes, thus controlling the pitch of the helical line.

Preferably, the pipes are guided towards a deflection face, the deflection face enclosing in a supply plane a first angle with the supply direction and a second angle with the supply plane. Thus, the pipes are deflected twice, firstly so as to bend over in the peripheral direction of the helical line, secondly so as to get an axial advance, which makes the helical line occur.

BRIEF DESCRIPTION OF THE DRAWINGS

In the following, the invention is described on the basis of preferred embodiments in connection with the drawings, showing.

DETAILED DESCRIPTION OF THE INVENTION

Figure 9:
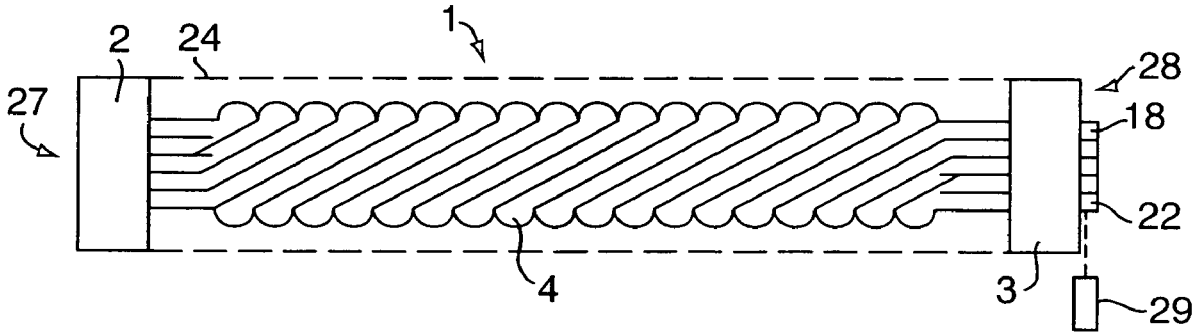
FIG. 9 is a conduit with connecting pieces.

FIG. 9 shows a conduit 1 with two connecting pieces 2, 3 and a body 4, whose manufacturing will be explained below.

Figure 1:
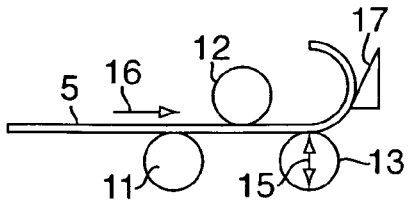
FIG. 1 is a schematic view explaining the manufacturing of a fluid conduit.
Figure 2:
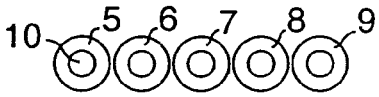
FIG. 2 is an arrangement of pipes.
Figure 3:
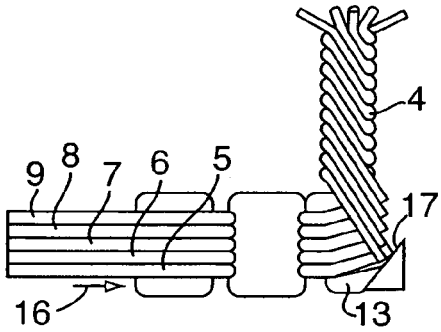
FIG. 3 is a top view according to FIG. 1.

The body 4 is formed by five pipes, shown in FIG. 1 in a side view, in FIG. 2 in a front view and in FIG. 3 in a top view. The wall thickness of these pipes 5-9 is shown in an enlarged view in FIG. 2. The wall thickness must be so large that it can stand a pressure, which is generated in the hollow inner chamber 10 of each pipe 5-9, when later the pipe 5-9 is used in a refrigeration system working with $CO_2$ (carbon dioxide) as refrigerant. Such pressures can easily have a magnitude of several 100 bar. However, pipes 5-9 with a smaller cross-section are comparatively more pressure resistant than pipes with a larger cross-section, but with the same wall thickness. The conduit 1 made in this manner can of course also be used with other refrigerants, also those working with smaller pressures.

Figure 4:
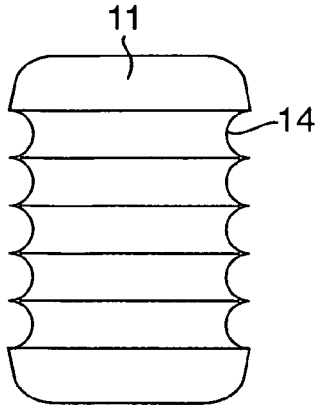
FIG. 4 is a grooved guide roller.

As can be seen from the FIGS. 1 and 3, the pipes 5-9 are guided over three guide rollers 11-13 in one plane to be adjacent to each other. All three guide rollers 11-13 have the same design. The guide roller 11 is shown in an enlarged view in FIG. 4. It has five peripheral grooves 14. The number of the peripheral grooves distributed evenly in the axial direction of the guide roller 11 of course depends on the number of pipes 5-9 to be wound simultaneously.

The two guide rollers 11, 12 are shown to be stationary. The guide roller 13 is movable in the direction of a double arrow 15, that is, perpendicularly to the plane, in which the pipes 5-9 are located during the supply.

Of course, the guide rollers 11, 12 can also be movable, if this should be required for an insertion process.

The pipes 5-9 are supplied in a feed direction 16. In this connection they can be unrolled from store spools, which are not shown in detail. Means, with which the feed is generated, are known per se and therefore not shown in detail. For example, roller pairs can be used, which act upon the pipes 5-9 from opposite sides, causing a drive on the pipes 5-9 by means of frictional force.

In the feed direction 16 behind the last guide roller 13 is located a deflection face 17. The directional component shown in FIG. 1 of this deflection face 17 encloses an angle different from 90° with the plane, in which the pipes 5-9 are supplied. The deflection face 17, or rather the recognisable component in FIG. 1, causes together with the last guide roller 13 that the pipes are bent over to be annular, so that in the view in FIG. 1 the shape of the bend appears to be practically circular.

As can be seen from FIG. 3, the deflection face 17 also encloses an angle different from 90° with the feed direction 16, so that the supplied pipes 5-9 are not only deflected to a circular path, but also receive a deflection perpendicular to the feed direction 16. Accordingly, the pipes 5-9 are guided on a helical line. To support this deflection movement, the last guide roller 13 can have a rotational axis in relation to the other guide rollers 11, 12, said rotational axis no longer being aligned in parallel with the axes of the guide rollers 11, 12, but enclosing an acute angle with them. Also the guide roller 12 can be located under an acute angle to the guide roller 11 to control the pitch of the helical line. The deflection face 17 serves the purpose of setting the pitch with a relatively large accuracy.

Figure 5:
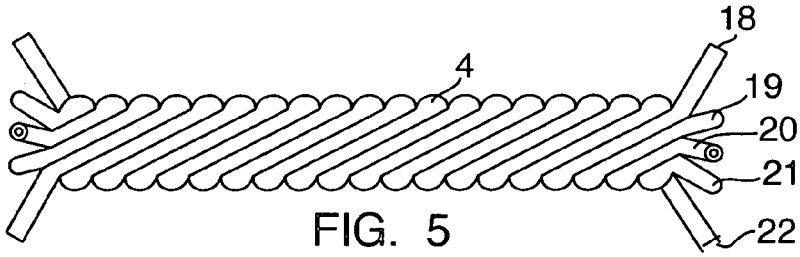
FIG. 5 is a pipe after manufacturing of the helical line shaped windings.
Figure 6:
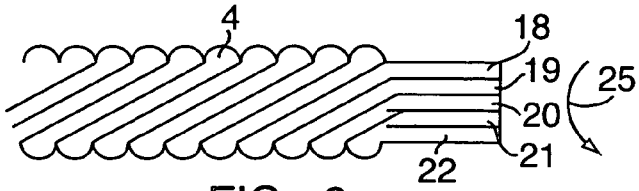
FIG. 6 is the pipe according to FIG. 5 with aligned ends.

As can be seen from the FIGS. 3 and 5, the pipes 5-9 are wound in the shape of a helical line, meaning that also during winding the parallel alignment of the pipes 5-9 in relation to each other is maintained. After the winding, the pipes 5-9 still bear on each other. The windings made in this manner form a hollow cylinder.

Now, the pipes 5-9 have ends, which project in an "inclined" manner from the body 4. This means that they have a radial and an axial directional component. However, all of them have substantially the same length. This is achieved in that the individual pipes 5-9 are not cut off at the same time, when the body 4 has reached its desired length, but are cut off sequentially. This means that when reaching the desired length, firstly one pipe, for example the pipe 5, is cut off, then the body 4 is further rotated, until the pipe 6 has reached the position of the previously cut off pipe 5, and the pipe 6 is cut off. This process is repeated, that is, between the cuttings of the individual pipes 5-9 a rotation takes place by an angle, which corresponds to 360° divided by the number of pipes.

In a further manufacturing step, the ends 18-22 are now bent over and aligned in parallel with the axis of the body 4. Then, it is possible to push the connecting piece 3 onto the ends 18-22. For this purpose, the connecting piece 3 comprises a number of bores 23, which corresponds to the number of pipes 5-9.

Figure 7:
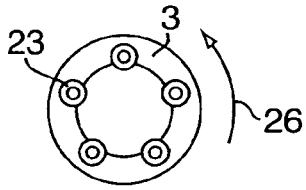
FIG. 7 is a connecting piece.
Figure 8A:
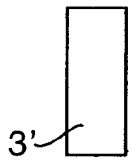
FIG. 8 is a second embodiment of a connecting piece.
Figure 8B:
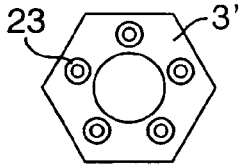

FIG. 7 shows a first embodiment of a connecting piece 3 with a circular shape. FIG. 8 shows a modified embodiment of a connecting piece 3' with a hexagon shape, as side view in FIG. 8*a* and as front view in FIG. 8*b*. The shape of the connecting piece 3, 3' depends on the desired application.

Before or after mounting of the connecting piece 3, the body 4 is provided with a plastic material 24 as shown in FIG. 9. The plastic material 24 could also be a natural rubber, which is used in a vulcanised form for this purpose. Expediently, the plastic material is manufactured in an injection moulding process. For this purpose, the body 4 is placed in an injection moulding die. Prior to that, however, the ends of the body are twisted in relation to each other against the winding direction. This is shown by means of the arrows 25, 26. The twisting angle is relatively small. It amounts to, for example, 10°. This results in a small clearance between adjacent windings of the body 4, into which the plastic material 24 can penetrate when injected. A core ensures that the hollow inside of the body 4 is not completely filled with plastic material 24. On the contrary, a hollow cylinder remains. After the injection of the plastic material 24, the tension, with which the ends of the body 4 have been twisted or "wound" in relation to each other, is released again, so that the wound pipes 5-9 to remain in the plastic material 24 with a certain pretension.

After embedding the body 4 in the plastic material, the two connecting pieces 2, 3 are pressed against the plastic material 24. This is indicated by means of arrows 27, 28. Of course, the corresponding forces are directed so that the connecting pieces 2, 3 bear with their full face on the front side of the plastic material 24. Then, the connecting pieces 2, 3 are welded or glued onto the plastic material 24, so that in total a practically monolithic block appears, in which a flow path for the carbon dioxide refrigerant is formed inside the pipes 5-9 bent in the shape of a helical line.

The ends 18-22 of the pipes 5-9 have such a length that, as shown with the connecting piece 3, they can be guided through the connecting piece 3 and project slightly from the connecting piece 3. This projection is cut off by means of a laser cutting device 29. Thus, it is achieved that the ends 18-22 can be flushed with the front side of the connecting piece 3.

Figure 10:
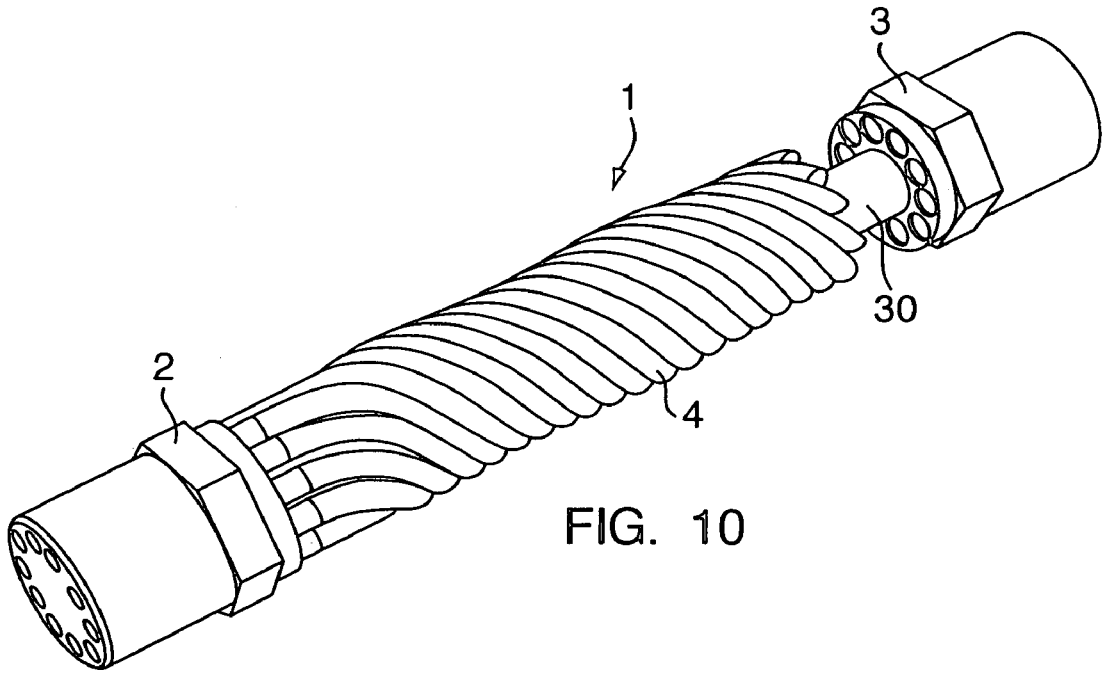
FIG. 10 is a perspective view of a modified embodiment of a conduit.

Until now, the conduit 1 has been described with five pipes 5-9. FIG. 10 shows a modified embodiment of a conduit 1, in which a total of ten pipes are helically wound to create a connection between two connections 2, 3. The hollow chamber which forms inside the body 4 is shown by means of a circular cylinder 30.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A method for the manufacturing of a fluid conduit, particularly a fluid conduit in a $CO_2$ refrigeration system, wherein several pipes are simultaneously supplied by means of at least one roller, which is provided with peripheral grooves, and are helically wound in a parallel direction with respect to each other, wherein each pipe is guided along a helical line, the helical lines of all pipes being parallel to each other;

wherein pipes are guided towards a deflection face, the deflection face enclosing in a supply plane a first angle with the supply direction, and a second angle with the supply plane.

2. The method according to claim 1, wherein after making the windings, the pipes are cut to length one by one, the bundle formed by the pipes being twisted by a predetermined angle between the individual cutting processes.

3. The method according to claim 1, wherein after winding the ends of the pipes are bent over in parallel to the axis of the helical line.

4. The method according to claim 1, wherein at least the helically shaped winding area of the conduit is embedded in a plastic material.

5. The method according to claim 4, wherein before the embedding, the ends of the conduit are twisted by a predetermined angle in relation to each other against the winding direction, are held in the twisted position during the embedding and are released after the embedding.

6. The method according to claim 4, wherein during embedding of the conduit a core within the windings is kept free.

7. The method according to claim 4, wherein ends belonging together are provided with a common connecting piece.

8. The method according to claim 7, wherein the connecting piece is connected to the plastic material.

9. The method according to claim 8, wherein the connecting piece is pressed against and welded onto the plastic material.

10. The method according to claim 7, wherein the ends of the pipes are guided through the connecting piece and an occurring excess length is cut off.

11. The method according to claim 10, wherein the cutting is made by means of laser.

12. The method according to claim 1, wherein at least one guide roller is provided, whose rotational axis encloses an acute angle in relation to the axis of the roller.

13. A method for manufacturing a fluid conduit, the method comprising:

providing at least one roller having a plurality of peripheral grooves;

supplying a plurality of pipes in a feed direction along the plurality of peripheral grooves wherein the plurality of pipes define a supply plane; and feeding the plurality of pipes in the feed direction towards a deflection face, wherein the deflection face forms a first angle and a second angle with respect to a plane perpendicular to the supply plane, wherein the first angle is formed when the deflection face is rotated about an axis substantially perpendicular to the feed direction and located in the supply plane and the second angle is formed when the deflection face is rotated about an axis perpendicular to the supply plane; and wherein a fed portion of the pipes deflects off the deflection face forming a helical winding.

14. The method according to claim 13, further comprising:

trimming the helical winding to length by:

cutting a pipe of the helical winding to length;

twisting the helical winding by a predetermined angle; and repeating the cutting step until each of the pipes of the helical winding is cut to length.

15. The method according to claim 13, wherein the first angle and the second angle are acute.

16. A method for manufacturing a fluid conduit, the method comprising:

providing at least one roller having a plurality of peripheral grooves;

supplying a plurality of pipes in a feed direction along the plurality of peripheral grooves wherein the plurality of pipes define a supply plane; and feeding the plurality of pipes in the feed direction towards a deflection face, wherein the deflection face is rotated about an axis substantially perpendicular to the feed direction and located in the supply plane and also rotated about an axis perpendicular to the supply plane; and wherein a fed portion of the pipes deflects off the deflection face forming a helical winding.

* * * * *